United States Patent [19]

Knappe

[11] Patent Number: 4,620,614

[45] Date of Patent: Nov. 4, 1986

[54] MULTIPLY EXTENSIBLE LIFTING FRAMES

[75] Inventor: Kurt Knappe, Sulzbach, Fed. Rep. of Germany

[73] Assignee: Linde Aktiengesellschaft, Wiesbaden, Fed. Rep. of Germany

[21] Appl. No.: 774,064

[22] Filed: Sep. 9, 1985

[30] Foreign Application Priority Data

Sep. 14, 1984 [DE] Fed. Rep. of Germany ..... 3433861

[51] Int. Cl.[4] ..... B66B 9/20

[52] U.S. Cl. ..... 187/9 E; 414/631; 137/355.17

[58] Field of Search ..... 187/9 E, 9 R, 1 R, 17; 254/93 R, 89 H; 414/629, 630, 631, 785, 918; 137/355.16, 355.17, 355.24

[56] References Cited

U.S. PATENT DOCUMENTS

| | | | |
|---|---|---|---|
| 3,339,768 | 9/1967 | Dixon | 187/9 E |
| 3,968,859 | 7/1976 | Ehrhardt | 187/9 E |
| 4,401,191 | 8/1983 | Bartow | 187/9 E |

*Primary Examiner*—Joseph J. Rolla
*Assistant Examiner*—Kenneth Noland
*Attorney, Agent, or Firm*—Buell, Ziesenheim, Beck & Alstadt

[57] ABSTRACT

A multiply extensible lifting frame is provided having a standing mast and one or more middle and inner masts slidable relative to one another, at least one lifting press cylinder connected with the standing mast having a piston connected to the intermediate mast, at least one chain connected at one end with the standing mast and at the other end with the inner mast and supported over a roller on the middle mast, an additional hydraulically actuated element connected with the inner mast and carrying a chain over a roller thereon, the chain connected at one end to the inner mast section and at the other end to the lift slide the improvement in which hoses provided for supplying the additional hydraulically actuated element connected with the farthest extensible mast section are carried in the same plane and which the at least one chain connected with the standing mast and the farthest extensible mast and each hose is connected with a connection in one end, a bore hold on the side of the front flange of the column of the inner mast section and the line to the additional hydraulically actuated member is connected to the other end of the bore hole.

5 Claims, 2 Drawing Figures

MULTIPLY EXTENSIBLE LIFTING FRAMES

Figure 2:
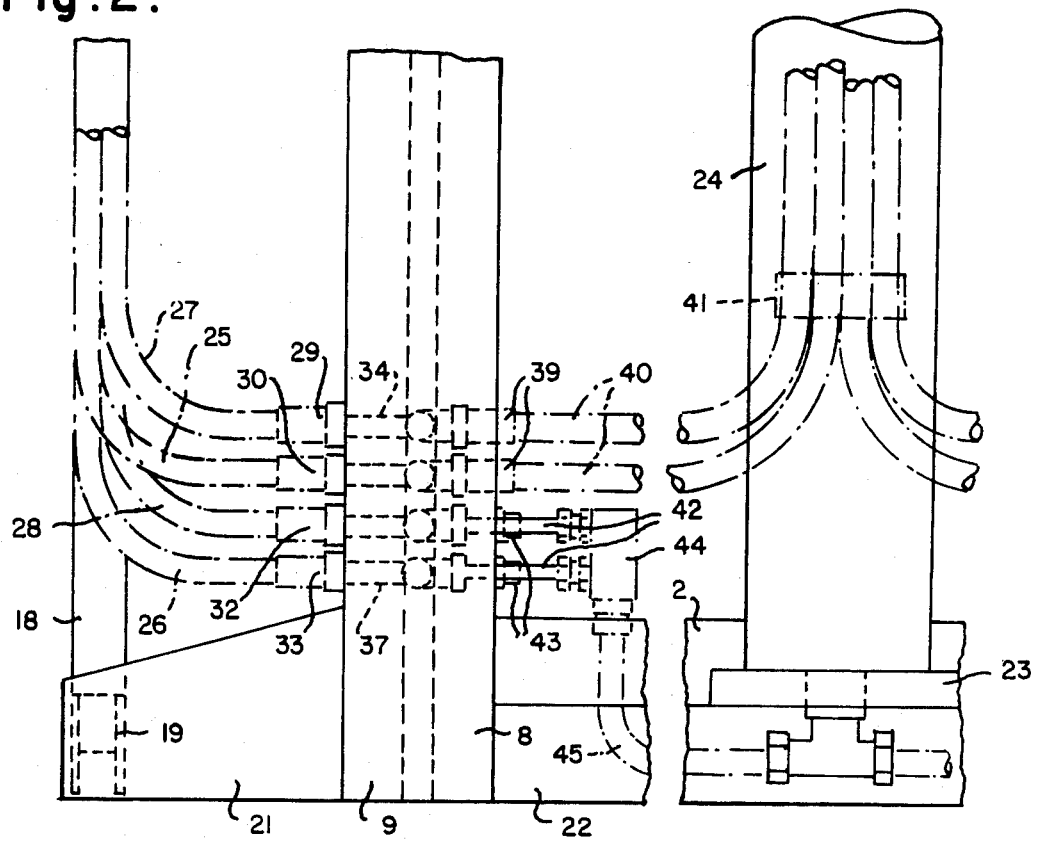

This application is related to my application, Ser. No. 774,065, filed on Sept. 9, 1985.

This application relates to multiply extensible lifting frames and particularly to a multiply extensible lifting frame for lift loaders with a standing mast connected directly or indirectly with the lift, loader frame and a middle mast section capable of sliding against it and an inner, farthest extensible mast section capable of sliding against the middle mast section, where each mast section has two lateral columns, in which case the lifting frame has at least one lifting press cylinder that is connected with the standing mast. where the piston rod of the piston capable of sliding in the lifting press cylinder is connected with the middle mast section and where at least one chain is provided, which is connected at one end with the standing mast and at the other end with the lower end of the inner mast section and is carried over a roller that is supported at the middle mast section, in which case an additional hydraulically actuated element is connected with the inner mast section, preferably an additional lifting press cylinder is provided, where a roller is supported on this additional lifting press and a chain is carried over it, which is fastened with its one end at the inner mast section and with its other end on the lift slide and where rollers are carried on the columns of the inner mast section and/or the lift slide is capable of sliding close by the inner side or the front side of the column of the inner mast section. The hydraulic device connected with the farthest extensible mast section can be a lifting press cylinder that is connected with this farthest extensible mast section, in which case a chain roller is connected with the piston rod and a chain is carried over this roller and it is also connected with this farthest extensible mast section as well as with the lift slide of the fork lift. However, this additional hydraulically actuated device can also be a hydraulically actuated additional device, e.g., for gripping, swivelling, etc., or it can be provided with such a lifting press cylinder of the described type as well as an additional device of the said type.

In the lifting masts known to date, the fluid had to be fed to the inner mast sections through hose lines that are fastened on the one hand at the standing mast section and on the other at the farthest extensible mast section and should be carried independently in some manner, e.g., in a long loop supported in guides.

The invention proposes to offer the most favorable arrangement possible for these feed lines of pressure medium to the device connected with the farthest extensible mast section, which is particularly favorable both with respect to the hose and its arrangement and with regard to impairment of vision conditions.

This problem is solved by an arrangement in which the hoses provided for supplying the additional element connected with the farthest extensible mast section are carried in the same plane in which the chain connected on the one hand with the standing mast and on the other hand with the farthest extensible mast section is also carried and that each hose is connected with a connection that is inserted into a borehole, which empties on the side of the front flange of the column of the inner mast section and which empties also at the rear side of the same column of the inner mast section, in which case a connection, to which a line that leads to the additional hydraulically actuated element is connected, is screwed into this second mouth of the borehole.

Due to the fact that the pressure medium is conveyed through the column profile itself, it is possible to feed the pressure medium without having a hose in a zone in which the lift slide passes close by the front side of the lifting mast column, or is carried in the roller of the lift slide or the lifting frame. It also becomes possible to run a hose precisely parallel to the chain so that it does not additionally narrow the field of vision, but also so that it is not excessively exposed to the danger of pinching or contusion.

A particularly advantageous arrangement results here where the at least one chain is carried in a plane lying parallel to the longitudinal median plane of the vehicle or where the lifting press connected on the one hand with the standing mast and on the other hand with the middle mast section is located immediately outside alongside the standing mast column, preferably a lifting press is located immediately outside alongside each standing mast column through which a chain arrangement results that impairs the field of vision particularly slightly and is particularly favorable with respect to the line of action of the chain force relative to the force of the piston rod of the lifting press.

Figure 1:
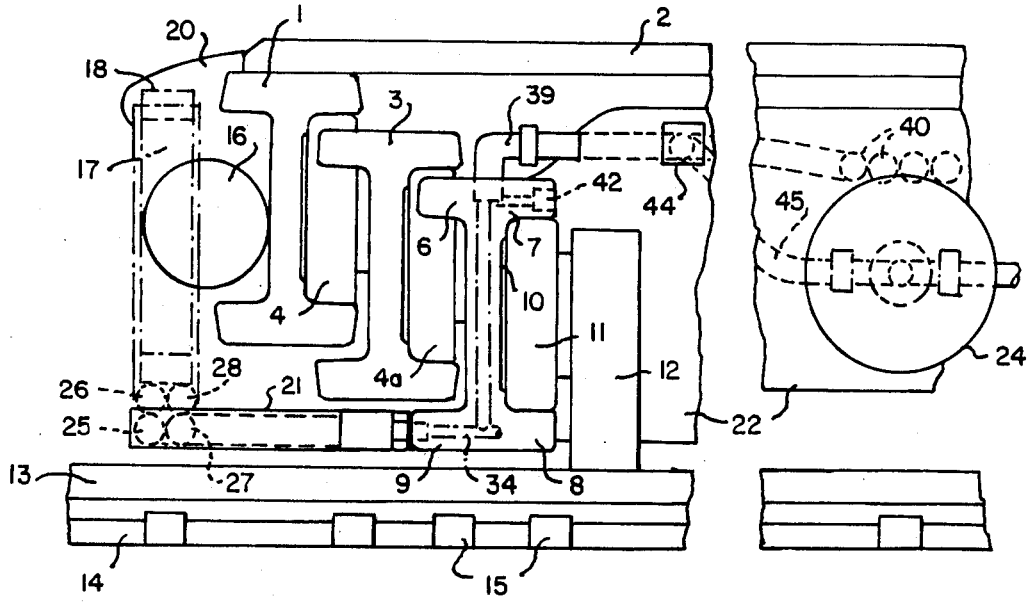

Certain objects, purposes and advantages of this invention are set out in the foregoing general description of this invention. Other objects, purposes and advantages of the invention will be apparent from a consideration of the following description and the accompanying drawings in which:

FIG. 1 shows a plan view of one-half of a lifting frame that extends up to the plane of symmetry; and FIG. 2 shows a front view of the same lifting frame, where the contours of the columns of the standing mast section and the middle mast section and the cylinder of the lifting press are left out to simplify the drawing.

The column of the standing mast section consists of a double-T section and is connected through a crosspiece 2 with a similar column on the other side of the lifting frame. The column 3 of the middle lifting frame is capable of sliding with respect to the standing mast column 1. It is supported against the latter by means of a roller 4 that is supported on the column 3 and runs between the flanges of the column 1. The column of the inner mast section also consists of a double-T section with the two rear flanges 6 and 7 and the two front flanges 8 and 9 and the web 10. The roller **4*a* is supported on the web 10, by means of which the column 6, 7, 8, 9, 10 is carried on the column 3. The roller 11 is carried between the two flanges 7 and 8. It is supported on the side section 12 of the fork carrier, which is connected with the fork carrier 13, which on its upper side has a holding web 14 that has notched recesses 15** in the usual manner.

The lifting press cylinder 16 is located between the two flanges of the standing mast column 1 that project outward. A piston rod that is not shown in the drawing is capable of being extended upward from the lifting cylinder 16. A sprocket wheel 17, which is designated only by dashed lines in FIG. 1, is connected with the piston rod. The chain 18, whose rear stringer in the drawing is connected by means of an adjustable chain anchor (not shown in the drawing) with a boom 20, which is rigidly connected with the crosspiece 2, is carried over the sprocket wheel 17.

A boom 21, to which the front stringer of the chain 18 is fastened by means of a second chain anchor 19, is rigidly connected with the front flange 9 of the column 6, 7, 8, 9, 10 of the inner mast section.

The piston rod extensible from the lifting press cylinder 16 is also connected with the column 3 of the middle mast section in a manner not shown in the drawing.

The mechanism of operation is as follows: If the lifting press cylinder 16 is loaded with pressure, the piston rod moves out of it and thus lifts the inner mast section 3. At the same time, however, the sprocket wheel 17 is also raised. Because the chain 18 is connected on the one hand through the boom 20 with the crosspiece 2 and is carried on the other hand over the sprocket wheel 17, the front stringer of the chain 18 must be lifted at twice the speed of the middle mast section and its column 3. Because the front stringer of the chain 18 is rigidly connected through the boom 21 with the column 6, 7, 8, 9, 10 of the inner mast section, this inner mast section is thus lifted with a speed that is twice as great as the lifting speed with which the middle mast section 3 is lifted.

The chain 18 lies here in a plane parallel to the longitudinal median plane of the vehicle and projects hardly at all toward the side over the lifting press cylinder, such that the field of vision is only slightly impaired more than the lifting press cylinder 16 itself for the operator.

The column 6–10 of the inner mast section is supported on a crosspiece 22, on which the bottom plate 23 of the lifting press cylinder 24 is supported, from which a piston rod (not shown) is extensible. A chain roller (not shown), over which a chain (not shown), which is fastened with its rear stringer at the crosspiece 22 and is fastened with its front stringer at the fork carrier 13, is carried, is also supported on the end of the piston rod.

Four hoses 25, 26, 27 and 28 (only symbolically indicated) are carried parallel to the chain 18, such that they do not narrow the field of vision of the operator any more than does the chain 18 itself. Each of these hoses is brought to a connection 29–33, which is screwed into the mouth of a horizontal borehole 34 or 35 or 36 or 37. Each of these boreholes empties into a borehole 38, also running horizontally and passing lengthwise through the web 10, in which case a connecting section is screwed into each of the two upper boreholes 38, where a hose 40 is carried in each of these two connections 39, where the two hoses 40 are supported over a clamping collar 41, which is fastened to the lifting cylinder 24, and serve to supply an additional hydraulic system fastened on the lift side with pressure medium.

The two lower boreholes 38 in the drawing are closed at their ends by a stopper. A borehole 42, also horizontal, in the mouths of which a connecting section 43 is screwed, empties in each of these boreholes 38. A hose 45 that serves to supply the lifting press cylinder 24 with pressure medium is connected through an elbow 44 to the two connections 43. With this arrangement it is possible to supply the components that are capable of sliding with the column 6–10, together with the inner mast section, with pressure medium and to carry the hoses required parallel to the lifting chain 18 and still to come to the parts of the inner mast section without coming into the movement space of the rollers **4, 4*a* or 11** or the mast sections capable of sliding relative to each other.

If the standing mast section 1, 2 and the middle mast section with the columns 3 are left out and the columns 6–10 are fastened with the crosspiece 22 as standing mast columns, the lifting frame that results can be used as a simple lifting frame. If the columns 6–10 are capable of sliding relatively with respect to the columns 3 and the columns 3 are established as standing mast sections, we have a duplex frame. Both the single and the duplex frames can be set up with the same structural components. The individual features of the invention with respect to the arrangement of the chain and its fastening to the extensible mast section and the arrangement of the hoses and the feeding of pressure medium into the extensible mast section can accordingly be used not only in lifting frames with standing mast sections, a middle mast section and an inner mast section (triplex frames), but accordingly also in other frames, e.g., in frames with columns corresponding to the columns 1, 3 and 6–10 shown in the implementation example, but without a lifting press cylinder connected with the farthest extensible mast section, such that the same chain conveyance and chain fastening are possible, or, if another hydraulic device to be supplied with pressure medium is provided instead of the lifting press cylinder 24, also with the hose arrangement described above.

Two different implementation forms, for two connections here, are shown in the drawing, on the one hand with the borehole 38 passing directly toward the back and the connections 39 and, on the other hand, with the borehole 38 connected by a stopper, with a lateral borehole 42. Depending on whether it is spatially more favorable in a given application, all the connections present can also be located on the rear side of the flange 6, 7 depending on the nature of the connections 39, or in the other implementation all the connections can be located on the lateral connection of the borehole 42 in the flange 7.

With the present-day production methods no difficulties are involved in effecting a long, straight borehole 38 through the narrow web 10 so that the wall of the borehole nowhere approaches the wall of the web 10 too closely, such that it no longer has the required resistance to pressure. Each borehole of this type does indeed weaken the web somewhat, but although in the lower region 6, 7 of the column 6, 7, 8, 9 the latter is loaded by the supporting forces of the lower rollers in the fork carrier, this lower region is stressed less by the bending stress due to its distribution over the length, such that this weakening of the web and the flanges in this region is quite acceptable.

In the foregoing specification, I have set out certain preferred practices and embodiments of this invention, however, the invention may be otherwise practiced within the scope of the following claims.

I claim:

1. In a multiply extensible lifting frame for lift loaders having a standing mast connected with the lift loader frame and a middle mast section capable of sliding against it and an inner, farthest extensible mast section capable of sliding against the middle mast section, each mast section having two lateral columns, at least one lifting press cylinder in the lifting frame connected with the standing mast, a piston rod of the lifting press cylinder being capable of sliding in the lifting press cylinder and connected with the middle mast section, at least one chain connected at one end with the standing mast and at the other end with the lower end of the inner mast section, and carried over a roller supported at the middle mast section, an additional hydraulically actuated element connected with the inner mast section, a roller supported on this additional hydraulically actuated element, a chain carried over said roller on the additional hydraulically actuated element, said chain being fastened at one end at the inner mast section and at the other end on the lift slide, and rollers carried on one of the columns of the inner mast section and the lift slide are capable of sliding close by the inner side or the front side of the column of the inner mast section, the improvement comprising hoses provided for supplying the additional hydraulically actuated element connected with the farthest extensible mast section are carried in the same plane in which at least one chain connected on the one hand with the standing mast and on the other with the farthest extensible mast section is also carried and that each hose is connected with a connection that is inserted into a borehole having a first port on the side of the front flange of the column of the inner mast section and a second port also at the rear side of the same column of the inner mast section, a connection to which a line that leads to the additional hydraulically actuated element is connected, is screwed into this second port of the borehole.

2. A multiply extensible lifting frame as claimed in claim 1 wherein the additional hydraulically actuated element is a second lifting press cylinder and piston.

3. A lifting frame according to claim 1 or 2 wherein the at least one chain is carried in a plane lying parallel to the longitudinal median plane of the lift end.

4. Lifting frame according to claim 3 wherein the lifting press connected on the one hand with the standing mast and on the other hand with the middle mast section is located immediately outside alongside the standing mast column.

5. Lifting frame according to claim 3 wherein a lifting press connected on the one hand with the standing mast and on the other hand with the middle mast section is located immediately outside alongside each standing mast column.

* * * * *

UNITED STATES PATENT AND TRADEMARK OFFICE

CERTIFICATE OF CORRECTION

PATENT NO. : 4,620,614

DATED : November 4, 1986

INVENTOR(S) : KURT KNAPPE

It is certified that error appears in the above-identified patent and that said Letters Patent is hereby corrected as shown below:

Column 1, line 15, after mast, delete "." and insert --,--.

Column 3, line 43, after "section" insert --39--.

Column 6, line 8, delete "end", insert --loader--.

Signed and Sealed this

Seventh Day of April, 1987

*Attest:*

DONALD J. QUIGG

*Attesting Officer*

*Commissioner of Patents and Trademarks*